US006001197A

United States Patent [19]

Wagaman

[11] Patent Number: 6,001,197

[45] Date of Patent: Dec. 14, 1999

[54] LIQUID MONOPROPELLANT

[75] Inventor: Kerry L. Wagaman, Bryantown, Md.

[73] Assignee: The United States of America as represented by the Secretary of the Navy, Washington, D.C.

[21] Appl. No.: 09/140,412

[22] Filed: Aug. 26, 1998

[51] Int. Cl.[6] ..... C06B 31/00; C06B 31/28

[52] U.S. Cl. ..... 149/45; 149/46

[58] Field of Search ..... 149/1, 45, 46; 60/214, 217

[56] References Cited

U.S. PATENT DOCUMENTS

| | | | |
|---|---|---|---|
| 3,925,124 | 12/1975 | Tannenbaum | 149/74 |
| 4,219,374 | 8/1980 | Cziesla et al. | 149/75 |
| 4,292,098 | 9/1981 | Mastroianni et al. | 149/89 |
| 4,664,730 | 5/1987 | Allan | 149/36 |
| 4,946,522 | 8/1990 | Liedtke et al. | 149/36 |
| 5,060,973 | 10/1991 | Giovanetti | 280/736 |
| 5,223,057 | 6/1993 | Mueller et al. | 149/45 |

*Primary Examiner*—Charles T. Jordan
*Assistant Examiner*—Aileen J. Baker
*Attorney, Agent, or Firm*—John Forrest; Roger D. Johnson

[57] ABSTRACT

A liquid monopropellant having (1) from about 10 to about 80 weight percent of an substituted ammonium nitrate which is methylammonium nitrate, dimethylammonium nitrate, trimethylammonium nitrate, ethylammonium nitrate, diethylammonium nitrate, n-propylammonium nitrate, isopropylammonium nitrate, ethanolammonium nitrate, diethanolammonium nitrate, triethanolammonium nitrate, or mixtures thereof, (2) from about 5 to about 60 weight percent of ammonium nitrate, and (3) from about 5 to about 50 weight percent of water.

A second embodiment of this invention is a monopropellant in which ammonium nitrate is omitted and from about 60 to about 95 weight percent of the substituted ammonium nitrate and from about 5 to about 40 weight percent of water is used.

18 Claims, No Drawings

LIQUID MONOPROPELLANT

BACKGROUND

This invention relates to propellants and more particularly to liquid monopropellants.

Conventional liquid monopropellants contain components that are very corrosive or toxic. Otto fuel II, for instance, contains nitrate esters that are toxic, corrosive, and readily chemically degraded by metal contaminates. Other conventional liquid monopropellants usually contain either (1) hydrazine or its derivatives or (2) hydroxylammonium nitrate or its derivatives which are toxic, corrosive, and readily chemically degraded by metal contaminates. For example, U.S. Pat. No. 5,223,057 titled, "Monopropellant Aqueous Hydroxyl Ammonium Nitrate/Fuel," which issued to Kurt F. Mueller et al. on Jun. 29, 1993, discloses monopropellants containing hydroxylammonium nitrate or derivatives there of such as the N-methyl, N-ethyl, O-methyl, or O-ethyl derivatives of hydroxylammonium nitrate.

It would be desirable to provide new liquid monopropellants which do not contain such corrosive and toxic ingredients. However, such new liquid propellants must be relatively inexpensive, energetic, be easy to handle, have low sensitivities, and have a good shelf life.

SUMMARY

Accordingly, an object of this invention is to provide new liquid monopropellants.

Another object of this invention is to provide new liquid monopropellants which have a lower toxicity than conventional liquid monopropellants.

A further object of this invention is to provide new liquid monopropellants that are less corrosive than conventional liquid monopropellants.

Yet another object of this invention is to provide liquid monopropellants that are safe and easy to handle.

A still further object of this invention is to provide monopropellants that are free of hydrazine, hydroxylammonium nitrate and their derivatives.

An additional object of this invention is to provide monopropellants that are not chemically unstable in the presence of metal contaminates.

These and other objects of the invention are achieved by providing a liquid monopropellant having A. from about 12 to about 80 weight percent of an substituted ammonium nitrate which is methylammonium nitrate, dimethylammonium nitrate, trimethylammonium nitrate, ethylammonium nitrate, diethylammonium nitrate, n-propylammonium nitrate, isopropylammonium nitrate, ethanolammonium nitrate, diethanolammonium nitrate, triethanolammonium nitrate, or mixtures thereof, B. from about 5 to about 60 weight percent of ammonium nitrate, and C. from about 12 to about 50 weight percent of water.

A second embodiment of this invention is a monopropellant having

A. from about 50 to about 95 weight percent of a substituted ammonium nitrate which is methylammonium nitrate, dimethylammonium nitrate, trimethylammonium nitrate, ethylammonium nitrate, diethylammonium nitrate, n-propylammonium nitrate, isopropylammonium nitrate, ethanolammonium nitrate, diethanolammonium nitrate, triethanolammonium nitrate, or mixtures thereof; and B. from about 5 to about 50 weight percent of water.

DESCRIPTION

The first embodiment of the present invention is a liquid monopropellant comprising (1) a substituted ammonium nitrate, (2) ammonium nitrate, and (3) water. The monopropellant is formulated to avoid hydrazine and hydroxylammonium nitrate and their derivatives. The result is a liquid monopropellant of low toxicity and low corrosiveness which is easy and safe to handle and which is chemically stable. Additionally, the liquid monopropellant is inexpensive, has a long shelf life, and does not damage equipment during storage.

As is well known, substituted ammonium nitrates are the same as substituted amine nitrates. For example, ethylammonium nitrate and ethylamine nitrate refer to the same chemical compound. In this specification, substituted ammonium nitrates are used instead of substituted amine nitrates.

The substituted ammonium nitrate of this first monopropellant is preferably methylammonium nitrate, dimethylammonium nitrate, trimethylammonium nitrate, ethylammonium nitrate, diethylammonium nitrate, n-propylammonium nitrate, isopropylammonium nitrate, ethanolammonium nitrate, diethanolammonium nitrate, triethanolammonium nitrate, or mixtures thereof, more preferably methylammonium nitrate, ethylammonium nitrate, ethanolammonium nitrate or mixtures thereof, and still more preferably methylammonium nitrate, ethylammonium nitrate, or mixtures thereof, with ethylammonium nitrate being most preferred. These substitute ammonium nitrates fall either into the category of alkylammonium nitrates or alkanolammonium nitrates. As used here, the term substituted ammonium nitrate specifically excludes hydroxylammonium nitrate and its derivatives. Similarly, the term excludes hydrazine and its derivatives, including hydrazine nitrate and its derivatives. The substituted ammonium nitrate comprises preferably from about 10 to about 80, more preferably from 40 to 80, and still more preferably from 60 to 80 weight percent of this first liquid monopropellant.

Ammonium nitrate comprises preferably from about 5 to about 60, more preferably from 5 to 45, and still more preferably from 5 to 20 weight percent of this first liquid monopropellant. The ammonium nitrate is used to increase the oxygen content of the monopropellant. When the more fuel rich alkylammonium nitrate salts (such as triethanolammonium nitrate, isopropylammonium nitrate, or diethylammonium nitrate) are used, more ammonium nitrate will be added.

Water comprises preferably from about 5 to about 50, more preferably from 5 to 30, and still more preferably from 5 to 20 weight percent of this first liquid monopropellant. Sea water may be use for applications such as aircraft catapults or in torpedoes. However, fresh water is more preferred than sea water. For special applications, such as in automobile airbag inflators, distilled water is still more preferred.

In a second embodiment of this invention, the ammonium nitrate is left out of the monopropellant. This second monopropellant comprises (1) preferably from about 60 to about 95, more preferably from 70 to 95, and still more preferably from 80 to 95 weight percent of a substituted ammonium nitrate that is methylammonium nitrate, dimethylammonium nitrate, trimethylammonium nitrate, ethylammonium nitrate, diethylammonium nitrate, n-propylammonium nitrate, isopropylammonium nitrate, ethanolammonium nitrate, diethanolammonium nitrate, triethanolammonium nitrate, or mixtures thereof; more preferably methylammonium nitrate, ethylammonium nitrate, ethanolammonium nitrate or mixtures thereof, and still more preferably methylammonium nitrate, ethylammonium nitrate, or mixtures thereof, with ethylammonium nitrate being most preferred and (2) preferably from about 5 to about 40, more preferably from 5 to 30, and still more preferably from 5 to 20 weight percent of water.

The general nature of the invention having been set forth, the following examples are presented as specific illustrations thereof. It will be understood that the invention is not limited to these specific examples but is susceptible to various modifications that will be recognized by one of ordinary skill in the art.

Examples 1 through 14 of Tables 1 and 2 illustrate the liquid monopropellants of this invention. Table 1 presents the composition and Table 2 presents the properties of the liquid monopropellants of examples 1 through 14. Note that examples 1 through 8 illustrate the first type of liquid monopropellant which has (1) a substituted ammonium nitrate, (2) ammonium nitrate, and (3) water. Similarly, examples 9 through 14 illustrate the second type of liquid monopropellant which has (1) a substituted ammonium nitrate and (2) water.

TABLE 1

Composition of example propellants

| Example | % AN[1] | % MAN[2] | % EAN[3] | % EOAN[4] | % Water |
|---|---|---|---|---|---|
| 1 | 55.0 | | 30.0 | | 15.0 |
| 2 | 5.0 | | 80.0 | | 15.0 |
| 3 | 40.8 | | 18.4 | | 40.8 |
| 4 | 44.1 | | 11.9 | | 44.0 |
| 5 | 58.9 | | 15.9 | | 25.2 |
| 6 | 58.9 | | 15.9 | | 25.2 |
| 7 | 20.7 | | 66.8 | | 12.5 |
| 8 | 15.0 | | 70.0 | | 15.0 |
| 9 | | 20.0 | 65.0 | | 15.0 |
| 10 | | 25.0 | 65.0 | | 10.0 |
| 11 | | 20.0 | 60.0 | 20.0 | 5.0 |
| 12 | | 20.0 | 55.0 | 15.0 | 5.0 |
| 13 | | 15.0 | 60.0 | 15.0 | 10.0 |
| 14 | | 15.0 | 65.0 | 15.0 | 5.0 |

[1]AN is ammonium nitrate
[2]MAN is methylammonium nitrate (or methyamine nitrate)
[3]EAN is ethylammonium nitrate (or ethylamine nitrate)
[4]EOAN is ethanolammonium nitrate (or ethanolamine nitrate)

TABLE 2

Properties of example propellants

| Example | Freezing Point (C.) | Density (g/cc) | $I_{sp}$ | $\rho I_{sp}$ | $T_c$ (F.) | $P_c$ (psi) | C* |
|---|---|---|---|---|---|---|---|
| 1 | | | 200 | | 2516 | 1000 | 4067 |
| 2 | −28 | 1.22 | 184 | 223 | 1558 | 1000 | 3355 |
| 3 | | 1.26 | 154 | 192 | 1233 | 1000 | 3119 |
| 4 | | 1.26 | 146 | 184 | 1208 | 1000 | 3033 |
| 5 | | 1.39 | 189 | 262 | 2339 | 1000 | 3886 |
| 6 | | 1.39 | 203 | 283 | 2339 | 1000 | 3887 |
| 7 | −15 | 1.28 | 189 | 242 | 1672 | 1000 | 3563 |
| 8 | | 1.26 | 185 | 233 | 1599 | 1000 | 3367 |
| 9 | −30 | | 185 | | 1585 | 1000 | 3488 |

TABLE 2-continued

Properties of example propellants

| Example | Freezing Point (C.) | Density (g/cc) | $I_{sp}$ | $\rho I_{sp}$ | $T_c$ (F.) | $P_c$ (psi) | C* |
|---|---|---|---|---|---|---|---|
| 10 | −12 | | 191 | | 1668 | 1000 | 3709 |
| 11 | −15 | | 205 | | 1912 | 1000 | 3708 |
| 12 | −17 | | 208 | | 2014 | 1000 | 3949 |
| 13 | −31 | 1.23 | 200 | 246 | 1804 | 1000 | 3660 |
| 14 | −17 | | 204 | | 1881 | 1000 | 3882 |

Table 3 presents physical properties and performance data for some conventional liquid propellants which can be compared against the propellants of this invention. These conventional propellants have the disadvantage of being expensive, corrosive, and toxic. Approximate costs for these conventional propellants is 6 dollars per pound as compared to less than two dollars per pound for comparable quantities of the new liquid monopropellants of this invention.

TABLE 3

Monopropellants

| Monopropellant | Freezing Pt (F.) | Density (g/cc) | $I_{sp}$ | $T_c$ (F.) | $P_c$ (psi) | C* |
|---|---|---|---|---|---|---|
| Otto Fuel II | −23 | 1.23 | 206 | 2048 | 1000 | 3534 |
| NOSET-A | −48 | 1.30 | 204 | 2056 | 1000 | 3960 |
| NOS-283 | −38 | 1.47 | 213 | 3075 | 1000 | 4349 |
| NOS-365 | −28 | 1.40 | 223 | 3399 | 1000 | 4545 |
| NOS-413 | −19 | 1.44 | 232 | 3704 | 1000 | 4720 |

Otto FueI II is a propylene glycol dinitrate-based fuel.
NOSET-A is a triethylene glycol dinitrate-based fuel.
NOS-283 and NOS-365 contain hydroxylammonium nitrate (HAN), isopropylammonium nitrate (IPAN), and water.
NOS-413 contains hydroxylammonium nitrate, ethylammnonium nitrate, and water.

The liquid monopropellants of this invention offer a number of advantages. First, they are non-flammable; they cannot be lit by a match. Second, the monopropellants have zero organic vapor emission which means there are no toxic or explosive organic vapors. Third, the monopropellants have a high thermal stability (>220 C). Fourth, the liquid monopropellants are biodegradable and readily water soluble, reducing clean up and disposal costs. Fifth, the storage life of these monopropellants is projected to be greater than twenty years. Sixth, chemical costs for these monopropellants is expected to be less than 2 dollars per pound.

Obviously, other modifications and variations of the present invention may be possible in light of the foregoing teachings. It is therefore to be understood that within the scope of the appended claims the invention may be practiced otherwise than as specifically described.

What is claimed is:

1. A liquid monopropellant consisting essentially of

A. from about 10 to about 80 weight percent of a substituted ammonium nitrate which is methylammonium nitrate, dimethylammonium nitrate, trimethylammonium nitrate, ethylammonium nitrate, diethylammonium nitrate, n-propylammonium nitrate, isopropylammonium nitrate, ethanolammonium nitrate, diethanolammonium nitrate, triethanolammonium nitrate, or mixtures thereof, B. from about 5 to about 60 weight percent of ammonium nitrate, and C. from about 5 to about 50 weight percent of water.

2. The liquid monopropellant of claim 1 wherein the substituted ammonium nitrate is methylammonium nitrate, ethylammonium nitrate, ethanolammonium nitrate or mixtures thereof.

3. The liquid monopropellant of claim 2 wherein the substituted ammonium nitrate is methylammonium nitrate, ethylammonium nitrate, or mixtures thereof.

4. The liquid monopropellant of claim 3 wherein the substituted ammonium nitrate is ethylammonium nitrate.

5. The monopropellant of claim 1 wherein the substituted ammonium nitrate comprises from 40 to 80 weight percent of the monopropellant.

6. The monopropellant of claim 5 wherein the substituted ammonium nitrate comprises from 60 to 80 weight percent of the monopropellant.

7. The monopropellant of claim 1 wherein ammonium nitrate comprises from 5 to 45 weight percent of the monopropellant.

8. The monopropellant of claim 7 wherein ammonium nitrate comprises from 5 to 20 weight percent of the monopropellant.

9. The monopropellant of claim 1 wherein water comprises from 5 to 30 weight percent of the monopropellant.

10. The monopropellant of claim 9 wherein water comprises from 5 to 20 weight percent of the monopropellant.

11. A liquid monopropellant consisting essentially of:

A. from about 60 to about 95 weight percent of a substituted ammonium nitrate which is methylammonium nitrate, dimethylammonium nitrate, trimethylammonium nitrate, ethylammonium nitrate, diethylammonium nitrate, n-propylammonium nitrate, isopropylammonium nitrate, ethanolammonium nitrate, diethanolammonium nitrate. triethanolammonium nitrate, or mixtures thereof; and B. from about 5 to about 40 weight percent of water.

12. The liquid monopropellant of claim 11 wherein the substituted ammonium nitrate is methylammonium nitrate, ethylammonium nitrate, ethanolammonium nitrate, or mixtures thereof.

13. The liquid monopropellant of claim 12 wherein the substituted ammonium nitrate is methylammonium nitrate, ethylammonium nitrate, or mixtures thereof.

14. The liquid monopropellant of claim 13 wherein the substituted ammonium nitrate is ethylammonium nitrate.

15. The liquid monopropellant of claim 11 wherein the substituted ammonium nitrate comprises from 70 to 95 weight percent of the monopropellant.

16. The liquid monopropellant of claim 15 wherein the substituted ammonium nitrate comprises from 80 to 95 weight percent of the monopropellant.

17. The liquid monopropellant of claim 11 wherein water comprises from 5 to 30 weight percent of the liquid monopropellant.

18. The liquid monopropellant of claim 17 wherein water comprises from 5 to 20 weight percent of the monopropellant.

* * * * *